United States Patent [19]

Spence et al.

[11] 4,274,765

[45] Jun. 23, 1981

[54] MINING EQUIPMENT

[75] Inventors: Adam M. Spence, Doncaster; James R. Goff, Brockenhurst, both of England

[73] Assignee: Winster Engineering Limited, Ilkeston, England

[21] Appl. No.: 961,913

[22] Filed: Nov. 17, 1978

[30] Foreign Application Priority Data

Nov. 19, 1977 [GB] United Kingdom ..... 48282/77

[51] Int. Cl.[3] ..... E21C 35/20

[52] U.S. Cl. ..... 405/303; 299/43; 405/291

[58] Field of Search ..... 405/291, 248; 299/12, 299/34, 43; 138/120; 239/547, 536

[56] References Cited

U.S. PATENT DOCUMENTS

| | | | |
|---|---|---|---|
| 1,938,829 | 12/1933 | Hamer | 138/120 X |
| 2,162,108 | 6/1939 | Newman | 405/248 X |
| 2,194,474 | 3/1940 | Joy | 299/12 X |
| 2,673,453 | 3/1954 | Templeton | 405/248 |
| 2,693,222 | 11/1954 | Krupp | 138/120 X |
| 2,757,966 | 8/1956 | Samiran | 239/536 X |
| 3,016,201 | 1/1962 | Brogden | 239/536 X |
| 3,154,214 | 10/1964 | Baker | 138/120 X |
| 3,475,055 | 10/1969 | Snedden | 239/536 X |
| 3,815,374 | 6/1974 | Hogan | 405/248 |
| 3,906,733 | 9/1975 | Koppers | 405/296 |
| 3,997,039 | 12/1976 | Hubbard et al. | 299/43 X |
| 4,068,893 | 1/1978 | Weirich | 299/12 X |

*Primary Examiner*—Dennis L. Taylor

*Attorney, Agent, or Firm*—Merriam, Marshall & Bicknell

[57] ABSTRACT

In a system for the supply of fluid under pressure to machinery of an underground mine working, lengths of fixed conduit are secured to parts of the conveyor assembly, prior to the assembly of said parts at the underground mine working. When the conveyor assembly has been assembled, the length of fixed conduits are interconnected, either by straight lengths of flexible conduit, or by branched lengths of flexible conduit, where take off for fluid under pressure is required for the machinery, for example a roof support unit.

10 Claims, 4 Drawing Figures

MINING EQUIPMENT

BACKGROUND TO THE INVENTION

This invention is concerned with improvements relating to mining equipment, particularly to the supply of fluid under pressure to machinery in an underground mine working, such as hydraulic fluid under pressure to an advancing roof support unit. Whereas the invention will be described hereinafter in relation to its use in the underground mining of coal, it is to be appreciated that the invention is not so limited in its application, and may be used in the mining of other minerals.

In the mining system known as the "Long Wall" system, a conveyor assembly extends alongside an exposed seam of coal. Coal winning machinery, such as a cutter drum, is mounted above the conveyor assembly (usually on rails provided by the conveyor assembly) and cuts into the face being worked as its traverses the face. Usually, the entire seam, from floor to ceiling, is taken out in one traverse, but if the seam is particularly deep, this may be done in two or more passes. Coal cut from the seam is deposited on the conveyor assembly, whereby it is removed from the face.

Usually after each cut, it is necessary to advance the conveyor assembly towards the newly-exposed face of the coal seam. Conventionally, this is performed by a number of advancing roof support units extending along the face, which push the conveyor assembly forwardly, behind the coal winning machine, and which subsequently draw themselves up towards the conveyor assembly. The conveyor assembly is built up from a number of sections connected together, each section comprising a pan for the conveyor belt, and a spill plate which is secured to the pan and which comprises a clevis rail.

Conventionally, fluid under pressure, (which is usually hydraulic) is delivered to the roof support units by means of a fluid hose supported by brackets mounted on or carried by part of the conveyor assembly, the hose being provided with T-junctions at intervals spaced along the length thereof, whereby hydraulic fluid may be delivered to individual roof support units. The setting up of the fluid supply system is difficult and time consuming, especially in view of the difficult conditions usually prevailing at a mine face, and it is one of the various objects of this invention to facilitate the provision of a fluid supply system for an underground mine working.

BRIEF SUMMARY OF THE INVENTION

This invention provides a system for the supply of fluid under pressure to machinery of an underground mine working, the system comprising (a) lengths of fixed conduit permanently or semi-permanently connected to some at least of the individual sections of the mining conveyor; and (b) lengths of flexible conduit extending between the lengths of fixed conduit and connected thereto.

Thus, conveniently, the lengths of fixed conduit are in the form of metal (e.g. steel) pipes or tubes permanently connected to parts of the individual sections of the conveyor assembly such as by welding: Most conveniently, the lengths of fixed conduit are secured to the outer side of the spill plate of the conveyor assembly (that is, on the side of the spill plate remote from the face being worked), preferably at a position close to the clevis rail, to prevent interference with the movement of the service cable or cables supplying fluid and electricity to the coal winning machine. Thus, each spill plate of the conveyor may initially be fabricated with such pipes secured thereto, that is before assembly of the conveyor in the mine working. Subsequent to the assembly of the conveyor, the system for the supply of fluid under pressure to the machinery may be completed quickly and conveniently by (inter alia) the interconnection of the lengths of fixed conduit by the lengths of flexible conduit by the use of quick release couplings.

The lengths of flexible conduit permit relative movement between adjacent sections of the conveyor (e.g. spill plate) during the snake-wise advancement of the conveyor without detriment to the supply system: additionally, lengths of flexible conduit comprising T-junctions may be used where desired, to which delivery conduits extending to the individual machines may be connected, conveniently also by the use of quick release couplings.

However, it is within the scope of this invention for the lengths of fixed conduit to be other than of rigid material (e.g. of flexible hose) and for them to be secured to the respective sections of the conveyor other than permanently (e.g. releasably, by bolting).

This invention also provides a spill plate for use in carrying out the invention set out in the last preceding paragraph but two, having secured thereto prior to the assembly of the spill plate as part of a conveyor assembly in a mine working, a length of conduit through which subsequent to the assembly of the spill plate, fluid under pressure may be delivered to the machinery.

This invention is particularly suitable for use in the provision of a system for the supply of hydraulic fluid to a row of advancing roof support units for an underground working.

According to another aspect of this invention there is provided a method of installation of a fluid supply system, for the supply of fluid under pressure to the roof support units of an underground mine working, said method involving the steps:

(a) connecting to some at least of the individual parts of a mining conveyor, prior to the assembly of said parts at an underground mine working, lengths of conduit; and (b) subsequent to the assembly of said parts of the conveyor, connecting said lengths of conduit together by lengths of flexible conduit by the use of quick release couplings.

The term quick release coupling is used herein in relation to any coupling means which may be interconnected and disconnected relatively quickly. In particular, the present invention envisages a quick release coupling in the form of a simple, push-interfit between adjacent conduits, together with the use of a simple retaining member which may be moved directly into engagement with end portions of such interfitted conduits to retain them against separative movement.

DETAILED DESCRIPTION OF A PREFERRED EMBODIMENT

Figure 1:
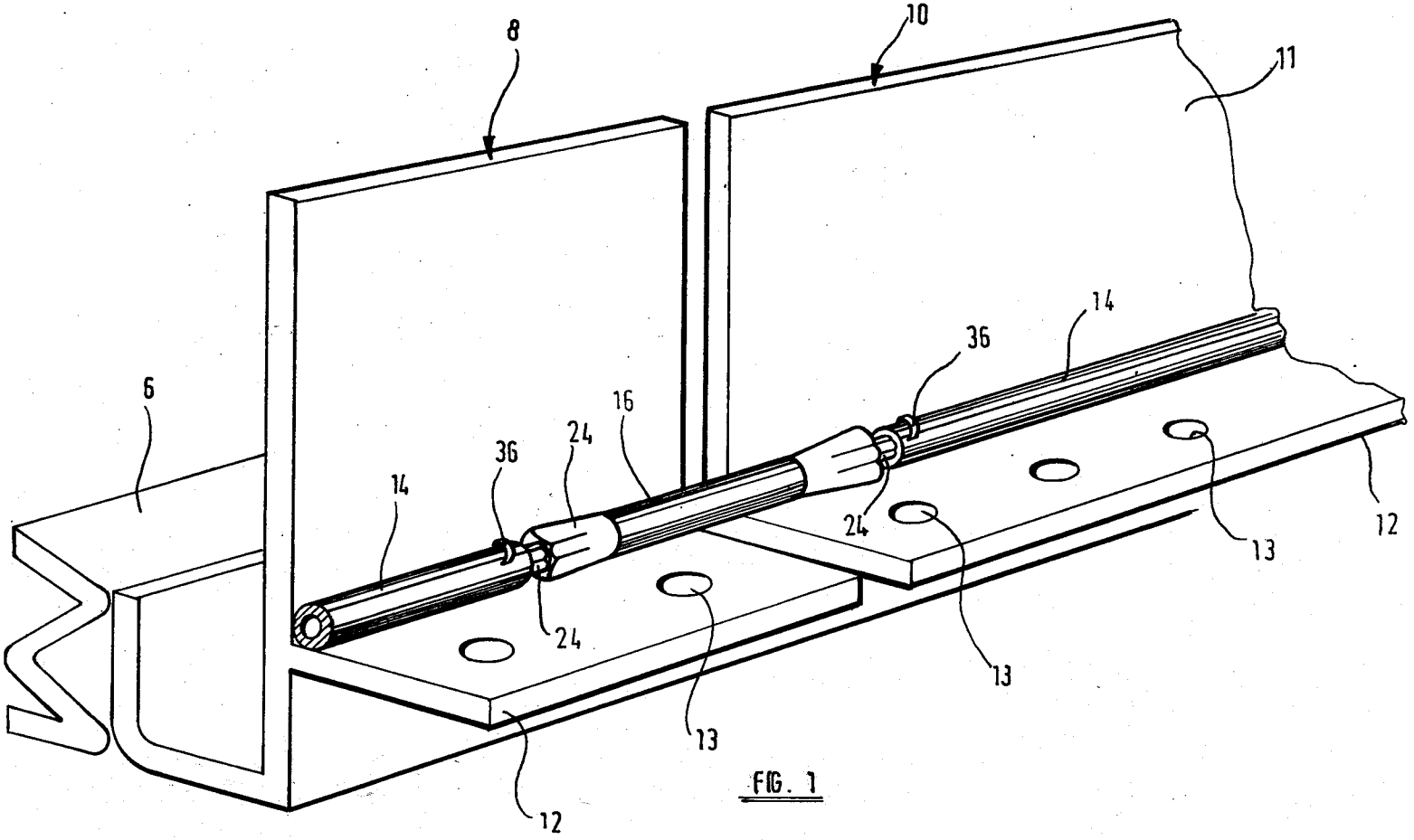
FIG. 1 is a schematic perspective view illustrating part of a system for the supply of fluid under pressure to underground mining machinery, which is a preferred embodiment of this invention, and which has been selected to illustrate this invention by way of example.
Figure 3:
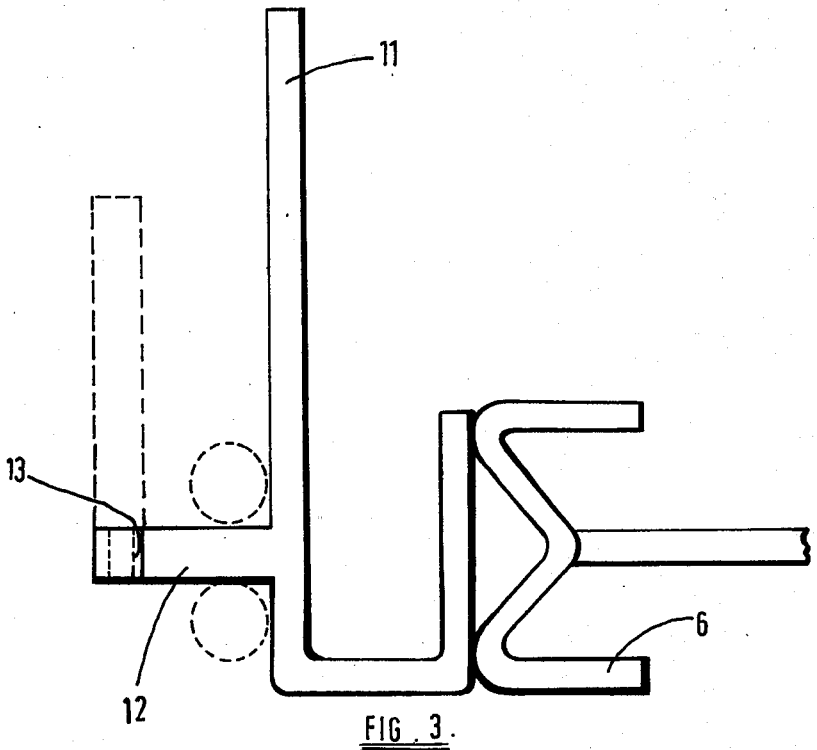
FIG. 3 is a schematic cross-sectional view.

FIG. 1 of the accompanying drawings shows part of two sections 8 and 10 of a mining conveyor assembly, each section comprising a spill plate 11, a clavis rail 12 (afforded with bores 13 for the mounting of fence posts, shown in dotted outline in FIG. 3, in conventional manner) and (secured on the inner side of the spill plate) a section of conveyor pan 6.

To each spill plate 8 and 10 a length of fixed conduit 14, afforded by steel pipe, is permanently secured by welding, and this is effected during manufacture of the spill plate, so that each spill plate, together with the fixed conduit 14 connected thereto, may be transported to the mine working and assembled in situ. However, the fixed conduits may be provided by lengths of flexible hose, and these may be semi-permanently (i.e. releasably) secured to the spill plate.

Figure 2:
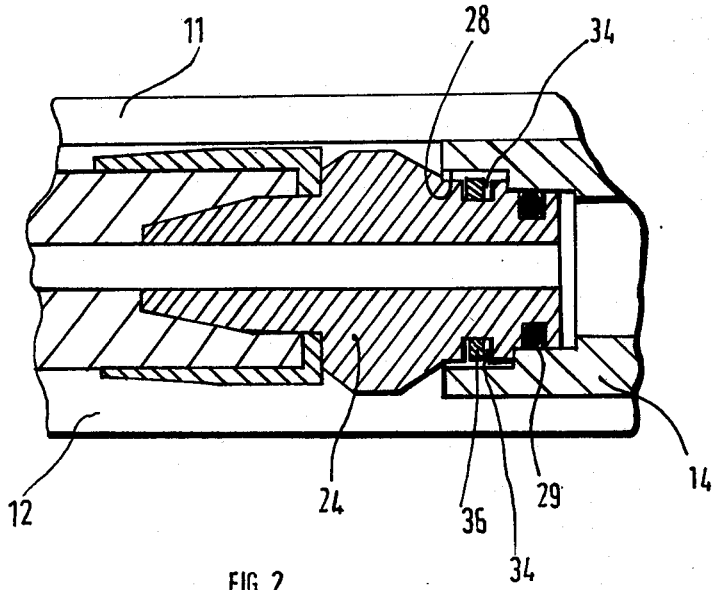
FIG. 2 is an enlarged sectional view of part of FIG. 1.

The system which is the preferred embodiment of this invention also comprises lengths of straight flexible conduit 16 for providing direct connection between the ends of adjacent lengths of fixed conduit 14, and lengths of branched flexible conduit 18 affording, not only a connection between the ends of adjacent lengths of fixed conduit 14, but also to a branch conduit 44 which may be connected to a roof support unit. Either a length of straight conduit 16 may be used (FIGS. 1 and 2) or a length of branch conduit 18 may be used (FIG. 4) as the circumstances require, by the use of quick release coupling means, described in detail hereinafter.

The end portion of each fixed conduit 14 is provided with a stepped bore 28. Opposite ends of each flexible conduit (14 and 18) are provided with a stepped connector member 24, which may be inserted into the stepped bore 28, such insertion being limited by engagement between shoulders thereof, an "O" ring 29 mounted in a circumferential channel in the connector member being in sealing engagement within the bore 28.

The end portion of each fixed conduit 14 is provided, outwardly of the shoulder thereof, with parallel bores 30 which are spaced apart a distance such as to extend tangentially through a circumferential channel 34 provided in the connector member 24, when the connector member is fully inserted into the bore 28. Thus, by the insertion of arms of a U-shaped retaining member 36 into the pair of bores 30, 30, such arms may pass into the channel 34 and prevent movement (specifically retractive movement) of the connector member 24 relative to the conduit 14.

In this manner, a length of straight conduit 16 may be connected between the ends of two adjacent fixed conduits 14, or removed therefrom when it is necessary to do so.

Conveniently the retaining member is in the form of a "staple" connector, which may if desired be appropriately shaped to resist withdrawing movement of the arms thereof from the parallel bores 30,30. Additionally, the use of a non-circular cross-section for the arms is advantageous, and in particular by the use of a rectangular cross-section, contact between the arms and the walls defining the bores 30, may be minimised, decreasing the resistance to removal of the staple connector as might be caused by corrosion of the staple within the bores.

Each length of branched, flexible conduit 18 comprises a central metal T-piece 40, and flexible conduit sections 42,42 connected to and extending between the ends of one of the conduits 14 and one arm of the T-piece (FIG. 4), the third arm of the T piece providing a branch outlet 20 which may be connected to branch conduit 44 extending to an adjacent roof support unit. Quick-Release coupling means is provided, to connect the flexible conduit sections 42 to the ends of the lengths of fixed conduit 14, and to the T piece 40, and to connect the outlet 20 to the branch conduit 44. Thus, in the section of the system shown in FIG. 4, there are five connections between the various rigid conduits, flexible conduit sections, and T-piece. These are similar, and similar to the connection of the straight conduit 16, with the fixed conduit 14, and will not be further described.

It will be appreciated that other forms of Quick release coupling may be used in the performance of this invention, and in particular a quick release coupling not requiring the use of a spanner or the like tool may be used to advantage, since the proximity of the fixed conduits 14 to the part of the conveyor assembly would tend to interfere with the use of, for example, a spanner.

Figure 4:
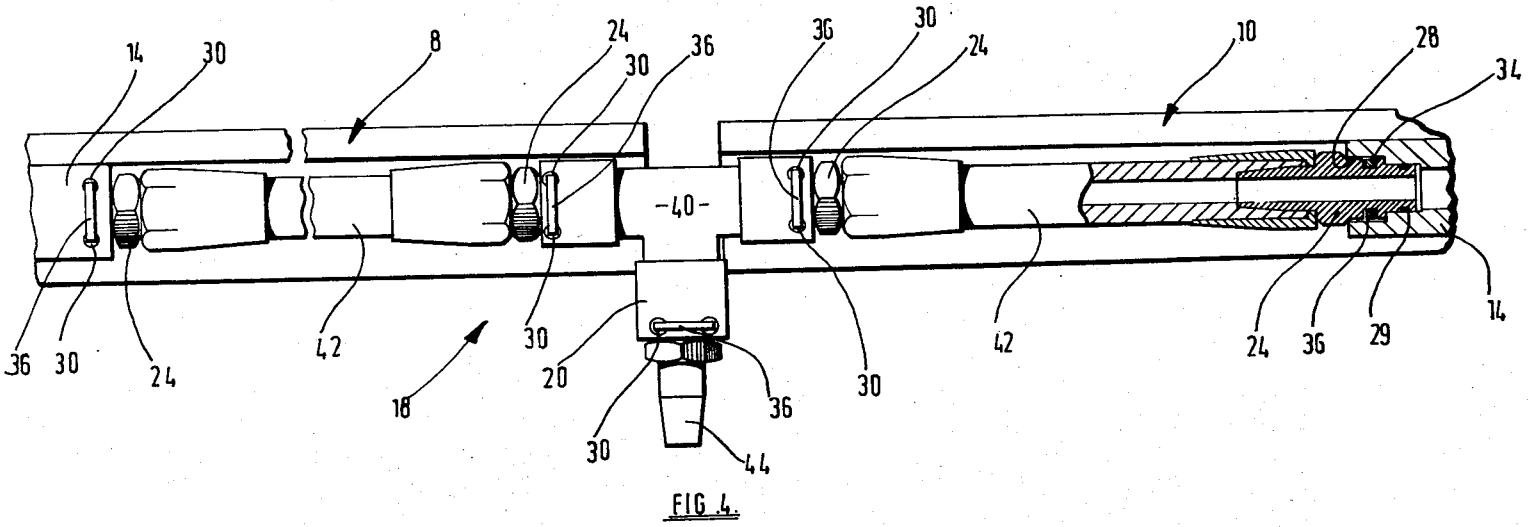
FIG. 4 is a schematic side elevation illustrating another part of the system which is the preferred embodiment of this invention.

In the setting up of the system which is the preferred embodiment of this invention, the various parts of the conveyor assembly (including conveyor pan, spill plate and clevis rail and the like) will be transported to the face to be worked, and will be assembled in a conventional manner. Between the sections 14 of fixed conduit from which a take off point is not required, a length of straight flexible conduit 16 will be used, as is shown in FIG. 1, and where a take off point is required (to supply power, for example, to a roof support unit) a length of flexible branch conduit will be used, as is shown in FIG. 4. In this manner, assembly of the hydraulic supply system may be carried out speedily and efficiently, and may, if it subsequently found necessary to alter the system, such as for example to supply a further take off point, be readily modified.

By virtue of the flexibility of the length 14 or 16, together with the use of a coupling which prevents separative movement between the conduit sections, no problems will be caused during snake-wise advancement of the conveyor, during advancement thereof towards the face being worked.

Whereas the invention has hereinabove been described in relation to the supply of hydraulic fluid under pressure for powering roof support units, it will be appreciated that the system may be used for the supply of fluid under pressure for powering other machinery, or may if desired be used to provide a supply of water under pressure at one or more points along the length of the face being worked.

Thus, where necessary, two such conduit systems may be attached to the conveyor assembly, for example conveniently at both positions illustrated in dotted lines in FIG. 3 of the accompanying drawings.

We claim:

1. In a system for the supply of fluid under pressure to machinery of an underground mine working, the improvement wherein lengths of fixed conduit are permanently or semi-permanently secured to some at least of the individual sections of a mining conveyor at the underground mine working and, to the assembly of said sections, said lengths of fixed conduit are secured together by lengths of flexible conduit and by the use of quick release couplings, inter-engageable elements of which are secured to the ends of the fixed conduits and to the ends of the flexible conduits respectively.

2. In a mining conveyor in an underground mine working, the conveyor comprising a number of prefabricated conveyor sections assembled together in the mine working, the conveyor supporting a supply system for the supply of fluid under pressure to machinery in the mine working, the improvement wherein the supply system comprises:

(a) lengths of fixed conduit secured permanently or semi-permanently to some at least of the sections of the conveyor, said lengths of conduit having quick release coupling elements connected to their ends; and (b) lengths of flexible conduit, said lengths of flexible conduit also having quick release coupling elements connected to their ends and which are interengaged with the quick release coupling elements of the lengths of fixed conduit.

3. A mining conveyor according to claim 2 wherein the lengths of fixed conduit are in the form of metal pipes connected to the individual sections of the mining conveyor.

4. A mining conveyor according to claim 3 wherein the lengths of fixed conduit are permanently fixed to the individual sections of the mining conveyor such as by welding.

5. A mining conveyor according to claim 2 wherein the lengths of fixed conduit are in the form of flexible conduit.

6. A mining conveyor according to claim 5 wherein the lengths of fixed conduit are afforded by lengths of hose connected to the individual sections of the mining conveyor.

7. A mining conveyor according to claim 5 wherein the lengths of fixed conduit are releasably secured to the sections of the conveyor.

8. A mining conveyor according to claim 7 wherein the lengths of fixed conduit are bolted to the sections of the conveyor.

9. A mining conveyor according to claim 2 wherein the lengths of fixed conduit are secured to the spill plate of the conveyor.

10. A mining conveyor according to claim 9 wherein the lengths of fixed conduit are secured adjacent to the clevis rail on the outer side of the spill plate.

* * * * *